US009867466B2

(12) United States Patent
Lovley, II

(10) Patent No.: US 9,867,466 B2
(45) Date of Patent: Jan. 16, 2018

(54) FOLDABLE CHAIR

(71) Applicant: ShelterLogic Corp., Watertown, CT (US)

(72) Inventor: Jack B. Lovley, II, Lake Forest, CA (US)

(73) Assignee: ShelterLogic Corp., Watertown, CT (US)

( * ) Notice: Subject to any disclaimer, the term of this patent is extended or adjusted under 35 U.S.C. 154(b) by 0 days.

(21) Appl. No.: 14/969,417

(22) Filed: Dec. 15, 2015

(65) Prior Publication Data

US 2016/0166062 A1 Jun. 16, 2016

Related U.S. Application Data

(60) Provisional application No. 62/092,178, filed on Dec. 15, 2014, provisional application No. 62/107,134, filed on Jan. 23, 2015.

(51) Int. Cl.

| | |
|---|---|
| ***A47C 4/00*** | (2006.01) |
| ***A47D 1/02*** | (2006.01) |
| ***A47C 4/28*** | (2006.01) |
| *A47C 4/38* | (2006.01) |
| *A47C 4/34* | (2006.01) |
| *A47C 4/20* | (2006.01) |
| *A47C 4/48* | (2006.01) |

(52) U.S. Cl.

CPC ..... *A47C 4/286* (2013.01); *A47C 4/28* (2013.01); *A47C 4/20* (2013.01); *A47C 4/283* (2013.01); *A47C 4/34* (2013.01); *A47C 4/38* (2013.01); *A47C 4/48* (2013.01)

(58) Field of Classification Search

CPC .... A47C 4/48; A47C 4/38; A47C 4/34; A47C 4/283; A47C 4/28; A47C 4/286; A47C 4/20

USPC ..... 297/16.1, 463.1, 39, 46

See application file for complete search history.

(56) References Cited

U.S. PATENT DOCUMENTS

| | | | |
|---|---|---|---|
| 33,398 | A | 10/1861 | Miller |
| 292,941 | A | 2/1884 | Nunnelley |
| 574,235 | A | 12/1896 | Bennitt |
| 900,572 | A | 10/1908 | Morton |
| 914,774 | A | 3/1909 | Zimmerman |

(Continued)

FOREIGN PATENT DOCUMENTS

| | | |
|---|---|---|
| AU | A 15170/92 | 12/1993 |
| CH | 635 393 | 3/1983 |

(Continued)

OTHER PUBLICATIONS

International Search Report and Written Opinion in International Application PCT/US2015/065781, dated Mar. 2, 2016 in 13 pages.
U.S. Appl. No. 13/892,132, filed May 10, 2013, Canopy Structure.
U.S. Appl. No. 13/929,667 (now U.S. Pat. No. 8,746,267), filed Jun. 27, 2013, Height-Adjustable Canopy Leg.

(Continued)

*Primary Examiner* — Chi Q Nguyen
(74) *Attorney, Agent, or Firm* — Carmody Torrance Sandak & Hennessey LLP

(57) ABSTRACT

According to some embodiments, a folding chair comprises a first frame element, a second frame element, wherein the first frame element moves from a first position remote from the second frame element to a second position toward, adjacent to or against the second frame element, and a cradle comprising a guide member that guides the first frame element into the cradle.

18 Claims, 10 Drawing Sheets

(56) References Cited

U.S. PATENT DOCUMENTS 1,024,176 A 4/1912 Boyens
1,075,372 A 10/1913 Overshiner
1,238,646 A 8/1917 Dennis
1,256,902 A 2/1918 Howe
1,334,048 A 3/1920 Powers
1,341,689 A 6/1920 Walmsley
1,429,043 A 9/1922 Martin
1,443,921 A 1/1923 Mackenzie
1,575,902 A 3/1926 Dial
1,593,431 A 7/1926 Buie
1,605,679 A 11/1926 McGrail
1,639,074 A 8/1927 Blackwood
1,666,757 A 4/1928 Snyder
1,763,455 A 6/1930 Bruijn
1,789,090 A 1/1931 Wawrunek
1,846,011 A 2/1932 Adams
1,915,504 A 6/1933 Stokby
2,001,252 A 5/1935 Johnson
2,070,484 A 2/1937 Jones
2,137,427 A 11/1938 Thomson
2,151,908 A 3/1939 Gottlieb
2,166,832 A 7/1939 Wenker
2,243,984 A 6/1941 Singewald
2,265,479 A 12/1941 Goodman
2,429,763 A 10/1947 Lindabury
2,490,367 A 12/1949 Maddocks
2,545,968 A 3/1951 Newstead
2,561,886 A 7/1951 Rikelman
2,571,382 A 10/1951 Raven
2,658,562 A 11/1953 Androsiglio
D171,176 S 12/1953 Yellen
2,689,603 A 9/1954 Smith
2,712,349 A 7/1955 Voir
2,719,688 A 10/1955 Seifert
2,729,276 A 1/1956 Volney
2,747,653 A 5/1956 Obradovich
2,752,929 A 7/1956 Berger
D180,210 S 4/1957 Uretsky
2,819,776 A 1/1958 Balsam
2,849,249 A 8/1958 Fridolph
2,926,724 A 3/1960 Rittenberg
2,932,047 A 4/1960 Johnston
2,989,968 A 6/1961 Gunter
3,007,735 A 11/1961 Cohn
3,034,523 A 5/1962 De Shano
3,085,586 A 4/1963 McDonough
3,092,224 A 6/1963 O'Neil
3,151,909 A 10/1964 Gerdetz
3,179,465 A 4/1965 Roberts
3,214,217 A 10/1965 Jente
3,243,230 A 3/1966 Otto
3,307,758 A 3/1967 Platt
3,309,134 A 3/1967 Roberts
3,333,595 A 8/1967 Bannister
3,339,566 A 9/1967 Bowden
3,371,671 A 3/1968 Kirkham
3,404,915 A 10/1968 Filho
3,450,432 A 6/1969 Minsker
3,544,157 A 12/1970 Muller
3,580,633 A 5/1971 Du Priest
3,621,857 A 11/1971 May et al.
3,637,086 A 1/1972 Klein
3,879,086 A 4/1975 Moceri
3,918,109 A 11/1975 Barraclough
3,931,918 A 1/1976 Smith et al.
3,935,874 A 2/1976 Cohen
3,947,903 A 4/1976 Menke
4,029,279 A 6/1977 Nakatani
4,030,748 A 6/1977 Brock
4,047,752 A 9/1977 Rohr
4,063,318 A 12/1977 Nicholson
4,082,102 A 4/1978 Heuer
4,123,095 A 10/1978 Stehlin
4,174,900 A 11/1979 Ina
4,201,416 A 5/1980 Vanderminden
4,248,255 A 2/1981 Arrowsmith
4,251,106 A 2/1981 Gilbert
D261,332 S 10/1981 Rohr
4,293,162 A 10/1981 Pap et al.
4,295,481 A 10/1981 Gee
4,300,798 A 11/1981 Musgrove et al.
4,445,590 A 5/1984 Ihrman
4,487,345 A 12/1984 Pierce et al.
4,497,092 A 2/1985 Hoshino
4,528,998 A 7/1985 Gamm
4,530,451 A 7/1985 Hamilton
4,536,026 A * 8/1985 Cornell ..... A47C 4/20 297/39
4,573,717 A 3/1986 Peacock
4,596,484 A 6/1986 Nakatani
4,635,667 A 1/1987 Harn
4,639,036 A 1/1987 Nichols
4,639,958 A 2/1987 Lerner
4,641,676 A 2/1987 Lynch
4,641,883 A 2/1987 Kato
D289,473 S 4/1987 Myers
4,687,248 A 8/1987 Ross et al.
4,687,249 A 8/1987 Mills
4,736,825 A 4/1988 Belfi
4,744,690 A 5/1988 Hsieh
4,761,092 A 8/1988 Nakatani
4,773,574 A 9/1988 Burgard
4,779,635 A 10/1988 Lynch
4,795,068 A 1/1989 Blean
4,796,734 A 1/1989 Distasic
4,809,724 A 3/1989 Fuser
4,810,029 A 3/1989 Kaladis et al.
4,824,171 A 4/1989 Hollingsworth
4,858,990 A 8/1989 Combs-Rose et al.
4,865,381 A 9/1989 Van Rogue
4,870,984 A 10/1989 Roth
4,885,812 A 12/1989 Linder
4,889,383 A 12/1989 Jones
4,915,120 A 4/1990 Ziolkowski
4,924,896 A 5/1990 Carter
4,932,622 A 6/1990 Hayakawa
4,949,929 A 8/1990 Kesselman et al.
D310,605 S 9/1990 Kwon
4,971,089 A 11/1990 Braman
4,972,981 A 11/1990 Gex
5,000,210 A 3/1991 Worthington, Jr.
5,013,085 A 5/1991 Craig
5,022,420 A 6/1991 Brim
5,035,253 A 7/1991 Bortles
5,042,874 A 8/1991 Williams
5,054,848 A * 10/1991 Liu ..... A47C 5/10 297/16.1
5,080,432 A 1/1992 Connell
5,096,257 A 3/1992 Clark
5,102,190 A 4/1992 Akin et al.
5,135,281 A 8/1992 Pappalardo
5,139,308 A 8/1992 Ziman
5,154,449 A 10/1992 Suei-Long
5,154,473 A 10/1992 Joranco
5,203,363 A 4/1993 Kidwell et al.
5,205,308 A 4/1993 Kendall et al.
5,209,381 A 5/1993 Jay
5,240,020 A 8/1993 Byers
5,244,001 A 9/1993 Lynch
5,244,250 A 9/1993 Nordmeyer
D339,937 S 10/1993 Ryan
5,289,958 A 3/1994 Jay
5,299,337 A 4/1994 Venza
5,303,975 A 4/1994 Asato
5,320,405 A 6/1994 Foster et al.
5,350,215 A 9/1994 DeMars
5,362,130 A 11/1994 Hoffman
5,387,048 A 2/1995 Kuo
5,388,821 A 2/1995 Blackburn
5,395,157 A 3/1995 Rollo et al.
5,421,356 A 6/1995 Lynch
D360,535 S 7/1995 Sjoberg
5,433,502 A 7/1995 Condorodis et al.
5,433,552 A 7/1995 Thyu

(56) References Cited

U.S. PATENT DOCUMENTS 5,441,067 A 8/1995 James et al.
5,449,014 A 9/1995 Yan-ho
5,485,863 A 1/1996 Carter
5,490,533 A 2/1996 Carter
5,511,572 A 4/1996 Carter
5,516,193 A 5/1996 Simpson
5,533,654 A 7/1996 Holty et al.
5,538,318 A 7/1996 MacLean
5,538,319 A 7/1996 DiMurro
5,544,793 A 8/1996 Harrop
5,547,246 A 8/1996 Lambert
5,551,110 A 9/1996 Armstrong et al.
5,551,669 A 9/1996 Reinklou
5,564,452 A 10/1996 Kitchen
5,579,797 A 12/1996 Rogers
5,582,458 A 12/1996 Wildt
5,593,205 A 1/1997 Vanderminden, Sr. et al.
5,593,239 A 1/1997 Sallee
5,597,101 A 1/1997 Barber et al.
5,626,271 A 5/1997 Messey et al.
5,632,292 A 5/1997 Carter
5,634,483 A 6/1997 Gwin
5,638,851 A 6/1997 Baldwin
D380,306 S 7/1997 Lin
D382,126 S 8/1997 Lee
D382,414 S 8/1997 Lee
5,695,100 A 12/1997 O'Brien
5,695,296 A 12/1997 Miura
5,718,473 A 2/1998 Lynch, Jr.
5,722,717 A 3/1998 Rittenberger
5,735,570 A * 4/1998 Tseng ..... A47C 4/20 297/35
5,794,640 A 8/1998 Jang
5,797,650 A 8/1998 Gonzalez, Jr. et al.
5,813,425 A 9/1998 Carter
5,819,999 A 10/1998 Tennant
5,833,310 A 11/1998 Labelle
5,873,625 A 2/1999 Uchtman
5,921,258 A 7/1999 Francois
5,934,301 A 8/1999 Carter
5,934,631 A 8/1999 Becker
5,951,103 A 9/1999 Barnhill
5,961,178 A 10/1999 Hodson
5,967,601 A 10/1999 Gillins
5,975,626 A 11/1999 Aycock
5,984,406 A 11/1999 Lee
6,000,175 A 12/1999 Gale et al.
6,006,477 A 12/1999 Ko
6,035,877 A 3/2000 Losi, Jr. et al.
6,036,262 A 3/2000 Shahid
6,045,177 A 4/2000 Grace
6,070,604 A 6/2000 Carter
6,082,813 A 7/2000 Chen
6,089,247 A 7/2000 Price
6,095,172 A 8/2000 Trapp et al.
6,095,596 A * 8/2000 Chen ..... A47C 4/20 297/35
6,102,479 A 8/2000 Wallace
6,112,757 A 9/2000 Tseng
6,129,102 A 10/2000 Carter
6,131,593 A 10/2000 Greene et al.
6,142,699 A 11/2000 Pao
6,148,835 A 11/2000 Rhee
6,152,156 A 11/2000 Tung
6,164,726 A 12/2000 Reeves et al.
6,179,514 B1 1/2001 Cheng
6,206,463 B1 3/2001 Whigham
6,230,729 B1 5/2001 Carter
6,241,311 B1 6/2001 Zheng
6,250,712 B1 6/2001 Livington et al.
6,263,895 B1 7/2001 Bang
6,264,271 B1 7/2001 Munn et al.
6,276,382 B1 8/2001 Bindschatel et al.
6,283,136 B1 9/2001 Chen
6,296,002 B1 10/2001 Tashchyan
6,328,131 B1 12/2001 Backus
6,354,044 B1 3/2002 Lagace, Jr.
6,363,956 B2 4/2002 Carter
6,371,553 B1 4/2002 Tang
6,405,742 B1 6/2002 Driscoll
6,412,507 B1 7/2002 Carter
6,418,949 B1 7/2002 Lin et al.
6,450,569 B1 * 9/2002 Liu ..... A47C 4/20 297/35
6,471,289 B2 10/2002 Aguilar
6,478,039 B2 11/2002 Suh
6,508,262 B1 1/2003 Takayama
6,516,821 B1 2/2003 Uemura
6,520,196 B2 2/2003 Carter
6,520,574 B1 2/2003 Huang
6,536,723 B1 3/2003 Nakatani
6,547,324 B1 4/2003 Ammann, Jr.
6,551,226 B1 4/2003 Webber et al.
6,575,656 B2 6/2003 Suh
6,591,849 B1 7/2003 Swetish et al.
6,655,736 B1 12/2003 Arenas
6,672,631 B1 1/2004 Weinhold
6,676,092 B2 1/2004 Tsai
D487,297 S 3/2004 Tyler et al.
6,698,827 B2 3/2004 Le Gette et al.
6,712,083 B2 3/2004 Carter
6,718,995 B2 4/2004 Dotterweich
D494,769 S 8/2004 Vigneaud
6,779,538 B2 8/2004 Morgante et al.
6,789,557 B1 9/2004 Wahl, Jr.
6,823,883 B1 11/2004 Sears
6,824,210 B2 11/2004 Zheng
6,837,642 B1 1/2005 Lin
6,845,780 B2 1/2005 Bishirjian
6,899,383 B2 5/2005 Hwang
6,908,249 B2 6/2005 Tomm
6,913,231 B2 7/2005 Speggiorin
6,926,355 B2 8/2005 Le Gette et al.
6,929,017 B2 8/2005 Byun
6,979,056 B1 12/2005 Goldszer
6,981,510 B2 1/2006 Carter
7,040,832 B2 5/2006 Hsieh
7,044,145 B2 5/2006 Bouchard
7,044,146 B2 5/2006 Losi, Jr.
7,048,333 B2 5/2006 Martinez
D522,605 S 6/2006 Bishirjian
7,066,676 B2 6/2006 Tsai
7,097,380 B2 8/2006 Lee
7,118,172 B1 10/2006 Pattison-Sheets
7,168,759 B2 1/2007 Gallegos Geier
7,172,532 B2 2/2007 Baker
7,198,324 B2 4/2007 Le Gette et al.
7,231,954 B2 6/2007 Green
7,240,685 B2 7/2007 Seo
7,240,687 B2 7/2007 Carter
7,243,990 B1 7/2007 Wahl
7,252,108 B2 8/2007 Carter
7,261,263 B2 8/2007 Baker et al.
7,293,934 B1 11/2007 Huang
7,296,584 B2 11/2007 Goldwitz
7,299,812 B2 11/2007 Carter
7,299,813 B2 11/2007 Ochi
7,302,745 B2 12/2007 Stahle
7,302,957 B2 12/2007 Ross
7,311,355 B2 12/2007 Fargason, III
7,316,450 B2 1/2008 Ayers et al.
7,350,532 B2 4/2008 Wu
7,373,708 B2 5/2008 Stahle et al.
7,374,238 B2 5/2008 Lingwall
7,380,563 B2 6/2008 Seo
7,395,830 B2 7/2008 Seo
7,396,073 B2 7/2008 Zheng
7,409,963 B2 8/2008 Mallookis et al.
7,422,009 B2 9/2008 Rummel et al.
7,422,026 B2 9/2008 Kim
7,427,101 B1 9/2008 Zernov
7,428,908 B2 9/2008 Seo
7,431,389 B2 10/2008 Reeb et al.
7,481,236 B2 1/2009 Carter

(56) References Cited

U.S. PATENT DOCUMENTS 7,494,296 B2 2/2009 Stahle
RE40,657 E 3/2009 Suh
7,527,331 B2 5/2009 Fargason, III
7,566,095 B2 7/2009 Reeb et al.
7,568,307 B1 8/2009 Zimhoni et al.
7,637,276 B2 12/2009 Mallookis et al.
D612,624 S 3/2010 Lovley et al.
7,673,643 B2 3/2010 Seo
7,703,469 B2 4/2010 Danzinger
7,735,504 B2 6/2010 Carter
7,753,063 B1 7/2010 Laws
7,753,064 B2 7/2010 Sy-Facunda
7,757,916 B1 7/2010 Petrie et al.
7,775,229 B2 8/2010 Sy-Facunda
7,784,480 B2 8/2010 Sy-Facunda
7,789,099 B2 9/2010 Mallookis et al.
D625,507 S 10/2010 Quinn
7,806,381 B2 10/2010 Sisk Horne et al.
7,836,907 B2 11/2010 Carter
7,849,867 B2 12/2010 Takayama
7,874,303 B2 1/2011 Xie
7,921,864 B2 4/2011 Carter
7,922,416 B2 4/2011 Davis et al.
7,954,272 B2 6/2011 Potterfield et al.
7,967,259 B2 6/2011 Nakatani
7,975,712 B2 7/2011 Beacco
7,980,519 B2 7/2011 Chen
7,997,291 B2 8/2011 Gressette et al.
8,006,711 B2 8/2011 Pietrzak et al.
8,025,455 B2 9/2011 Huang et al.
D648,148 S 11/2011 Henry
8,074,669 B2 12/2011 Collins et al.
8,075,217 B2 12/2011 Eason
8,079,380 B2 12/2011 Engstrom et al.
8,091,962 B2 1/2012 Quinn
8,128,306 B2 3/2012 Gorza
8,162,280 B2 4/2012 Yu et al.
8,185,979 B2 5/2012 Hentschel
8,186,755 B2 5/2012 Lovley
8,191,744 B2 6/2012 Petrie et al.
8,220,477 B2 7/2012 Park
8,376,646 B2 2/2013 Melino et al.
8,408,225 B2 4/2013 Mallookis et al.
8,418,711 B2 4/2013 Park
8,454,093 B2 * 6/2013 Smith ..... A47C 3/04 297/239
8,464,379 B1 6/2013 Zajac
8,590,553 B2 11/2013 Lovley et al.
8,608,118 B2 12/2013 Lai
8,616,226 B2 12/2013 Ma et al.
8,746,267 B2 6/2014 Lovley, II et al.
8,776,810 B2 7/2014 Lah et al.
D712,730 S 9/2014 Gridley
9,033,410 B2 * 5/2015 Roani ..... A47C 1/14 297/16.1
9,072,290 B1 7/2015 McCauley
D736,884 S 8/2015 Lovley, II et al.
D737,066 S 8/2015 Lovley, II et al.
9,101,222 B2 8/2015 Minkoff
9,103,138 B2 8/2015 Lovley, II
9,175,496 B2 11/2015 Darquea
9,220,347 B2 12/2015 Lovley, II et al.
9,279,269 B2 3/2016 Lovley, II et al.
D774,815 S 12/2016 Lovley, II et al.
9,528,292 B1 12/2016 Lovley, II et al.
2002/0030146 A1 3/2002 Akaike
2002/0112752 A1 8/2002 Blakney
2003/0090904 A1 5/2003 Ching
2003/0164185 A1 9/2003 Price
2004/0084074 A1 5/2004 Chiu et al.
2004/0101351 A1 5/2004 Pitcher
2004/0178665 A1 9/2004 May
2004/0182430 A1 9/2004 Seo
2004/0222678 A1 11/2004 Hansen
2004/0238021 A1 12/2004 Holub et al.
2004/0255997 A1 12/2004 Seo
2004/0261828 A1 12/2004 Jang
2005/0028856 A1 2/2005 Seo
2005/0081904 A1 4/2005 Suzuki et al.
2005/0155637 A1 7/2005 Kim
2005/0178419 A1 8/2005 Tseng
2005/0178422 A1 8/2005 Wu
2005/0194030 A1 9/2005 Goldwitz
2005/0205124 A1 9/2005 Goldwitz
2005/0249545 A1 11/2005 Tsai
2006/0051159 A1 3/2006 Tsai
2006/0054207 A1 3/2006 Wootliff
2006/0062632 A1 3/2006 Jang
2006/0096631 A1 5/2006 Mallookis
2006/0144434 A1 7/2006 Chen
2006/0169311 A1 8/2006 Hwang
2006/0174929 A1 8/2006 Tseng
2006/0249192 A1 11/2006 Tsai et al.
2006/0260666 A1 11/2006 Choi
2007/0012346 A1 1/2007 Choi
2007/0018486 A1 1/2007 Ayers et al.
2007/0040422 A1 2/2007 Reeb et al.
2007/0051397 A1 3/2007 Choi
2007/0145792 A1 6/2007 Miller
2007/0181172 A1 8/2007 Harrison
2007/0204897 A1 9/2007 Habib et al.
2007/0221263 A1 9/2007 Tai
2007/0236058 A1 10/2007 Yeider
2007/0240748 A1 10/2007 Bae
2008/0035194 A1 2/2008 Goldwitz
2008/0087313 A1 4/2008 Jang
2008/0121260 A1 5/2008 Stephens et al.
2009/0071521 A1 3/2009 Sy-Facunda
2009/0087251 A1 4/2009 Chen
2009/0218856 A1 9/2009 Sykes et al.
2009/0309394 A1 12/2009 Chen
2010/0064739 A1 3/2010 Lu
2010/0101617 A1 4/2010 Stehly
2010/0269877 A1 10/2010 Sy-Facunda
2010/0275962 A1 11/2010 Park et al.
2011/0023924 A1 2/2011 Park
2011/0023925 A1 2/2011 Johnson et al.
2011/0073148 A1 3/2011 Choi
2011/0181078 A1 7/2011 Kelly
2011/0192436 A1 8/2011 Gridley
2011/0240078 A1 10/2011 Lenhart et al.
2011/0259381 A1 10/2011 Adams
2011/0274481 A1 11/2011 Chen
2011/0284045 A1 11/2011 Reeb
2011/0308559 A1 12/2011 Ma et al.
2012/0006373 A1 1/2012 Stehly
2012/0034023 A1 2/2012 Wang et al.
2012/0107037 A1 5/2012 Huang
2012/0146354 A1 6/2012 Lofley, Sr. et al.
2012/0175917 A1 7/2012 Chen
2012/0305042 A1 12/2012 Lorbiecki
2013/0069400 A1 3/2013 Nikolic
2013/0247948 A1 9/2013 Lovley, II et al.
2013/0284225 A1 10/2013 Holland et al.
2014/0021749 A1 * 1/2014 Roani ..... A47C 1/14 297/16.1
2014/0158176 A1 6/2014 Lovley, II
2014/0174491 A1 6/2014 Yang
2014/0203619 A1 * 7/2014 Dapra ..... A47C 7/008 297/463.1
2014/0283891 A1 9/2014 Lovley, II et al.
2014/0306494 A1 10/2014 Frankel et al.
2015/0252587 A1 9/2015 Lovley, II
2015/0345172 A1 12/2015 Lovley, II
2016/0166062 A1 * 6/2016 Lovley, II ..... A47C 4/286 297/16.1

FOREIGN PATENT DOCUMENTS

CN 1104546 4/2003
CN 2705649 6/2005
CN 2880991 3/2007
CN 201216348 Y 4/2009
CN 102022609 A 4/2011

(56) References Cited

FOREIGN PATENT DOCUMENTS

| | | | |
|---|---|---|---|
| CN | 202055611 | U | 11/2011 |
| CN | 202706662 | U | 1/2013 |
| CN | 2545298 | | 4/2013 |
| DE | 26 55 028 | A1 | 6/1978 |
| DE | 31 31 166 | A1 | 2/1983 |
| DE | 35 360 49 | A1 | 4/1987 |
| DE | 42 01 743 | A1 | 10/1992 |
| DE | 10 2010 049 941 | | 5/2012 |
| EP | 0 564 326 | | 10/1993 |
| FR | 532 496 | A | 2/1922 |
| FR | 2 691 619 | | 12/1993 |
| FR | 2 805 559 | | 8/2001 |
| GB | 2 052 960 | A | 2/1981 |
| GB | 2 091 648 | | 8/1982 |
| GB | 2 216 850 | | 10/1989 |
| JP | 58-129855 | | 9/1983 |
| JP | 61-7351 | | 1/1986 |
| JP | 7 207 962 | | 8/1995 |
| JP | 3059720 | | 7/2000 |
| JP | 2001-003604 | | 1/2001 |
| JP | 2001-254535 | | 9/2001 |
| JP | 2002-209663 | | 7/2002 |
| JP | 2005-290837 | | 10/2005 |
| JP | 2011-144606 | | 7/2011 |
| KR | 10-2002-0048191 | | 6/2002 |
| KR | 10-2004-0023115 | | 3/2004 |
| KR | 20060001341 | | 1/2006 |
| KR | 10-0886118 | | 2/2009 |
| KR | 10-2011-0054253 | | 5/2011 |
| KR | 10-2014-0135004 | | 11/2014 |
| SU | 1174551 | | 8/1985 |
| WO | WO 82/01984 | | 6/1982 |
| WO | WO 91/14386 | | 10/1991 |
| WO | WO 94/023162 | | 10/1994 |
| WO | WO 96/39066 | | 12/1996 |
| WO | WO 2005/024158 | | 3/2005 |
| WO | WO 2007/018926 | | 2/2007 |

OTHER PUBLICATIONS

U.S. Appl. No. 14/295,094, filed Jun. 3, 2014, Height-Adjustable Canopy Leg.

U.S. Appl. No. 29/460,914 (now U.S. Pat. No. D736,884), filed Jul. 16, 2013, Adjustable Locking Leg Assembly for a Collapsible Canopy or the Like.

U.S. Appl. No. 29/536,490, filed Aug. 17, 2015, Adjustable Locking Leg Assembly for a Collapsible Canopy or the Like.

U.S. Appl. No. 14/043,752 (now U.S. Pat. No. 9,103,138), filed Oct. 1, 2015, Sliding-Eave Mount Mechanism for Canopy Structure.

U.S. Appl. No. 14/822,208, filed Aug. 10, 2015, Sliding-Eave Mount Mechanism for Canopy Structure.

U.S. Appl. No. 14/099,188, filed Dec. 6, 2013, Canopy Shelter Link Point.

U.S. Appl. No. 14/149,538 (now U.S. Pat. No. 9,279,269), filed Jan. 7, 2014, Canopy Shelter Brackets.

U.S. Appl. No. 14/199,770 (now U.S. Pat. No. 9,220,347), filed Mar. 6, 2014, Collapsible Chair With Integrated Collapsibe Shade Cover.

U.S. Appl. No. 14/983,342, filed Dec. 29, 2015, Collapsible Chair With Integrated Collapsible Shade Cover.

U.S. Appl. No. 29/484,192 (now U.S. Pat. No. D737,066), filed Mar. 6, 2014, Chair With Integrated Shade Cover.

U.S. Appl. No. 29/537,208 (now U.S. Pat. No. D774,815), filed Aug. 24, 2015, Shade Cover.

U.S. Appl. No. 12/333,713 (now U.S. Pat. No. 8,186,755), filed Dec. 12, 2008, Collapsible Canopy Along With Article of Furniture and Method Incorporating the Same.

U.S. Appl. No. 14/455,694 (now U.S. Pat. No. 9,528,292), filed Aug. 8, 2014, Canopy With Overhang.

U.S. Appl. No. 15/387,414, filed Dec. 21, 2016, Canopy With Overhang.

U.S. Appl. No. 14/607,459, filed Jan. 28, 2015, Canopy With Detachable Awning.

U.S. Appl. No. 14/969,539, filed Dec. 15, 2015, Collapsible Canopy.

* cited by examiner

FOLDABLE CHAIR

RELATED APPLICATIONS

This application claims priority to U.S. Provisional Patent Application No. 62/092,178, filed Dec. 15, 2014, and U.S. Provisional Patent Application No. 62/107,134, filed Jan. 23, 2015, the entire contents of both of which are incorporated herein by reference in their entireties.

FIELD

The present disclosure relates to foldable chairs and, in particular, to foldable chairs having improved frames and related frame components.

DESCRIPTION OF THE RELATED ART

Chairs with collapsible or folding frames are commonly used to provide portable seating for outdoor activities such as camping, picnicking, parties, weddings, and more. Such collapsible or folding frames typically comprise a collapsible or folding frame and a cover that is supported by the frame and defines one or more of a seat bottom, backrest or armrests of the chair. The chair is often configured to stand alone when in an expanded or deployed state and to collapse or fold into a collapsed or folded state for storage and transport. However, although collapsible or folding chairs exist, there remains a need for improved chair designs that address issues of prior designs or at least provide the consumer with a useful choice.

SUMMARY

The systems, methods and devices described herein have innovative aspects, no single one of which is indispensable or solely responsible for their desirable attributes. Without limiting the scope of the claims, some of the advantageous features will now be summarized.

According to some embodiments, a folding chair comprises a first frame element, a second frame element, wherein the first frame element moves from a first position remote from the second frame element to a second position toward, adjacent to or against the second frame element, and a cradle comprising a guide member that guides the first frame element into the cradle.

According to some embodiments, the cradle comprises a recess that is configured to receive at least a portion of the first frame element. In some embodiments, the recess is shaped and sized to receive a corresponding surface of the first frame element. In some embodiments, the recess comprises a circular or rounded shape. In some arrangements, the first frame element is configured to be positioned within the recess when the folding chair is open and adapted to receive an occupant.

According to some embodiments, the guide member comprises a guide surface that extends laterally along at least one side of the cradle so at to guide the first frame element within a recess of the cradle. In one embodiment, the guide surface is sloped relative to the direction in which the first frame element is configured to approach the cradle.

According to some embodiments, the chair further includes at least one guide element that guides the first frame element toward the second frame element. In some embodiments, the at least one guide element comprises at least one curved or rounded end portion that spaces a body of the guide element away from the first frame element when the first frame element is in the second position.

According to some embodiments, a folding chair comprises a first frame element, a second frame element, wherein the first frame element is configured to move from a first position when the folding chair is not extended and a second position when the folding chair is extended and configured to receive an occupant, wherein, in the second position, the first frame element is adjacent to or against the second frame element, and a guide member that guides the first frame element into a recess adjacent the guide member, wherein the recess is configured to receive at least a portion of the first frame element.

According to some embodiments, the recess is shaped and sized to receive a corresponding portion of the first frame element that is configured to be positioned within the recess. In some embodiments, the recess comprises at least a partially rounded or curved surface. In some arrangements, the guide member comprises a guide surface that extends laterally along at least one side of the cradle so at to guide the first frame element within the recess. In one embodiment, the guide surface is sloped (e.g., at an angle) relative to the direction in which the first frame element is configured to approach the guide member. In some embodiments, the slope angle is between 30 and 60 degrees (e.g., 30-35, 35-40, 40-45, 45-50, 50-55, 55-60 degrees, angles between the foregoing ranges, etc.), less than 30 degrees, greater than 60 degrees, as desired or required.

According to some embodiments, the guide member is located on or part of a cradle or similar feature or component that is secured to the chair. In some embodiments, the chair further includes at least one guide element that guides the first frame element toward the second frame element, wherein the at least one guide element comprises at least one curved or rounded end portion that spaces a body of the guide element away from the first frame element when the first frame element is in the second position.

According to some embodiments, a folding chair comprises a first frame element, a second frame element, wherein the first frame element moves from a first position remote from the second frame element to a second position toward, adjacent to or against the second frame element, and at least one guide element that guides the first frame element toward the second frame element, wherein the at least one guide element comprises at least one curved or rounded end portion that spaces a body of the guide element away from the first frame element when the first frame element is in the second position.

According to some embodiments, the at least one guide element comprises two curved end portions. In one embodiment, the at least one guide element is pivotally connected to both the first frame element and the second frame element. In some embodiments, the at least one guide element comprises a first guide element and a second guide element. In some arrangements, the first and second guide elements are positioned on opposite sides of the first frame element.

According to some embodiments, the folding chair further comprises a cradle comprising a guide member that guides the first frame element into the cradle, wherein the at least one guide element comprises at least one curved or rounded end portion that spaces a body of the guide element away from the first frame element when the first frame element is in the second position.

An aspect of the present application involves the realization that it can be desirable to guide portions of the frame toward other portions of the frame in moving between a folded and an unfolded orientation, but that some guide designs can present a pinching hazard. Accordingly, in some configurations, a folding chair has a first frame element that moves from a first position remote from a second frame element to a second position toward, adjacent or against the second frame element and includes at least one guide element that guides the first frame element toward the second frame element. The at least one guide element can have at least one curved end portion that spaces a body of the guide element away from the first frame element when the first frame element is in the second position.

In some configurations, the at least one guide element has two curved end portions.

In some configurations, the at least one guide element is pivotally connected to both the first frame element and the second frame element. In some configurations, the at least one guide element comprises a first guide element and a second guide element. In some configurations, the first and second guide elements are positioned on opposite sides of the first frame element.

BRIEF DESCRIPTION OF THE DRAWINGS

Throughout the drawings, reference numbers can be reused to indicate general correspondence between reference elements. The drawings are provided to illustrate example embodiments described herein and are not intended to limit the scope of the disclosure.

DETAILED DESCRIPTION

Figure 1:
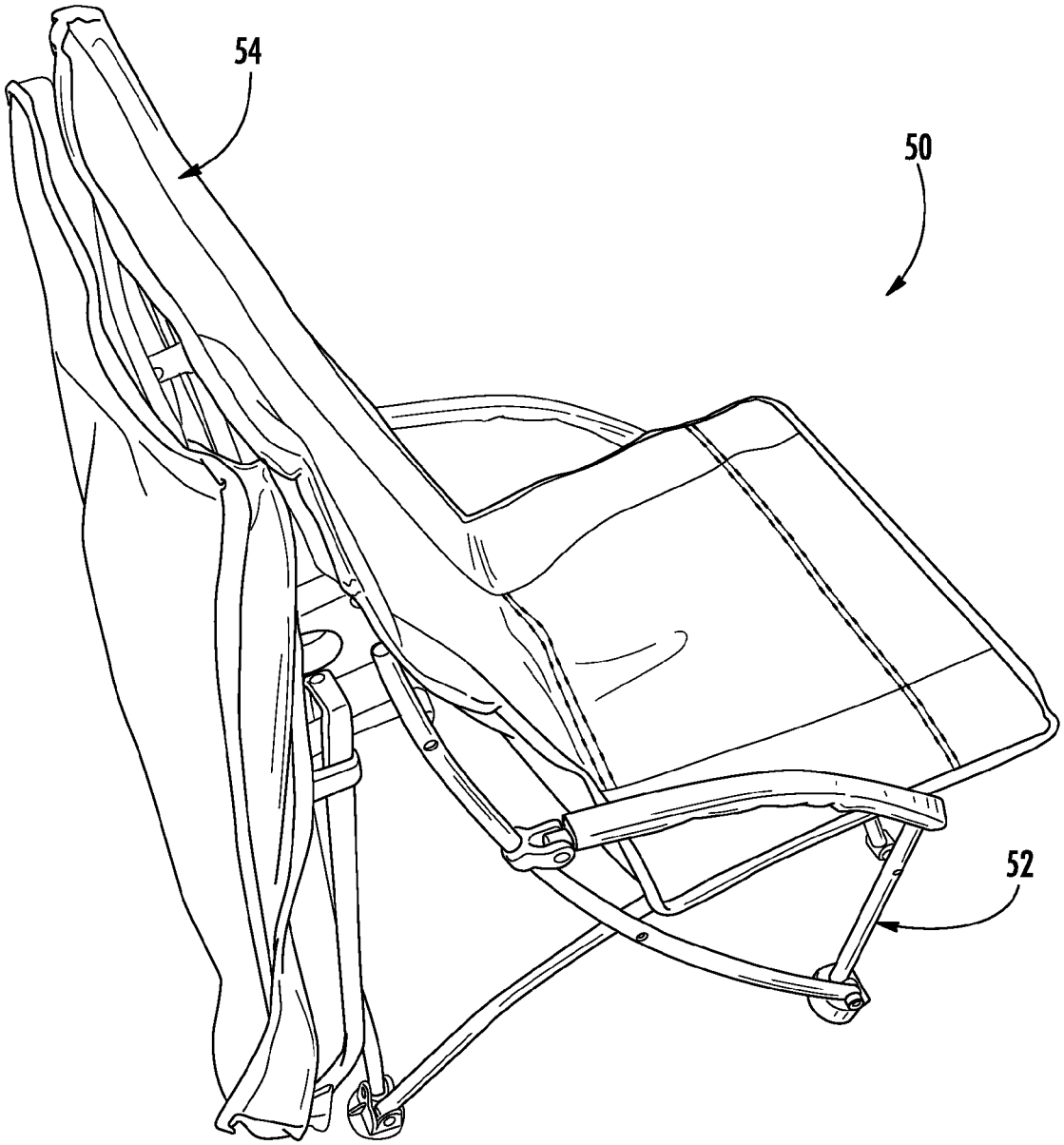
FIG. 1 illustrates a perspective view of one type of foldable chair having a frame and a cover according to one embodiment.
Figure 2:
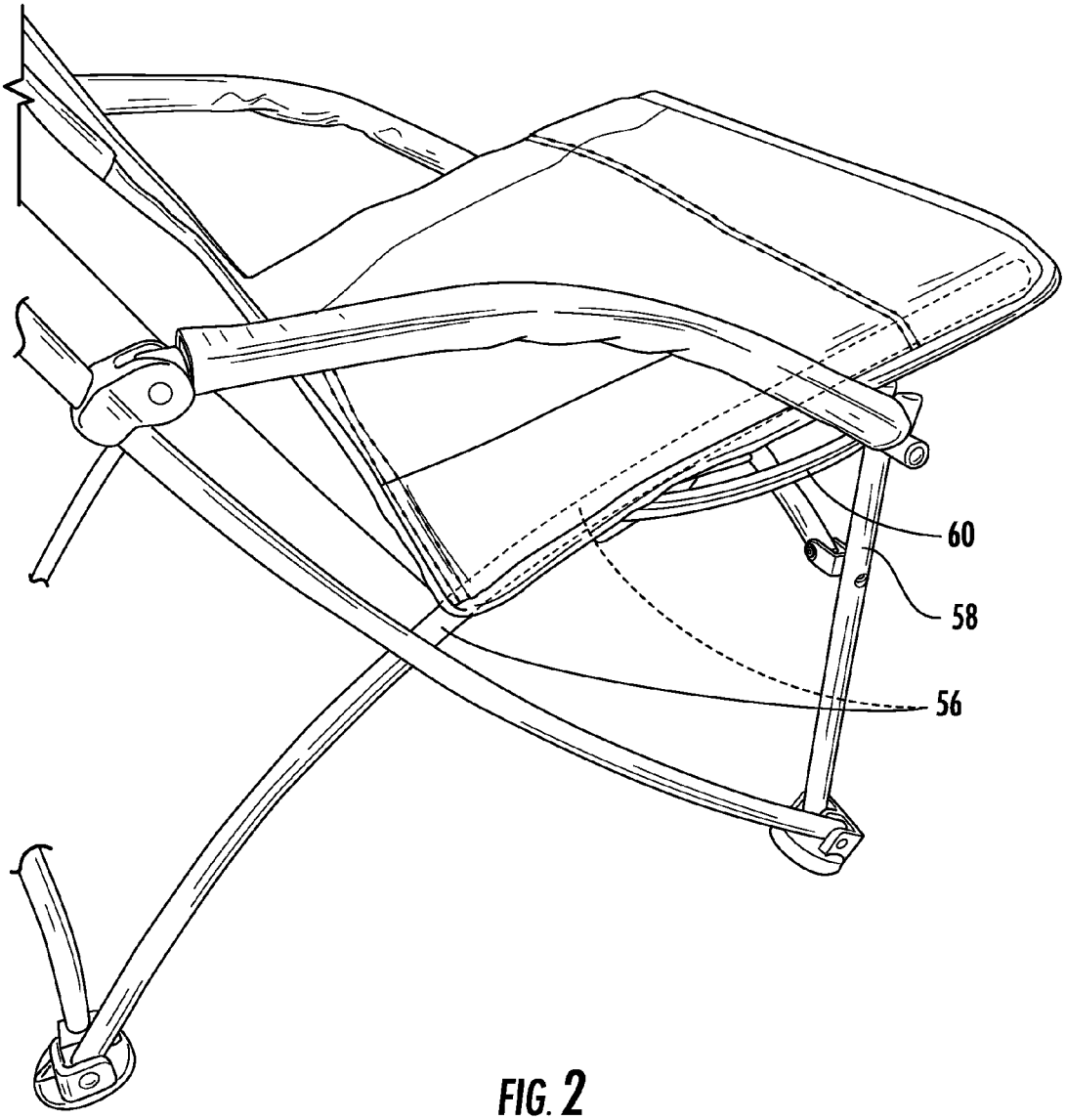
FIG. 2 illustrates a different perspective view of the foldable chair of FIG. 1.
Figure 3:
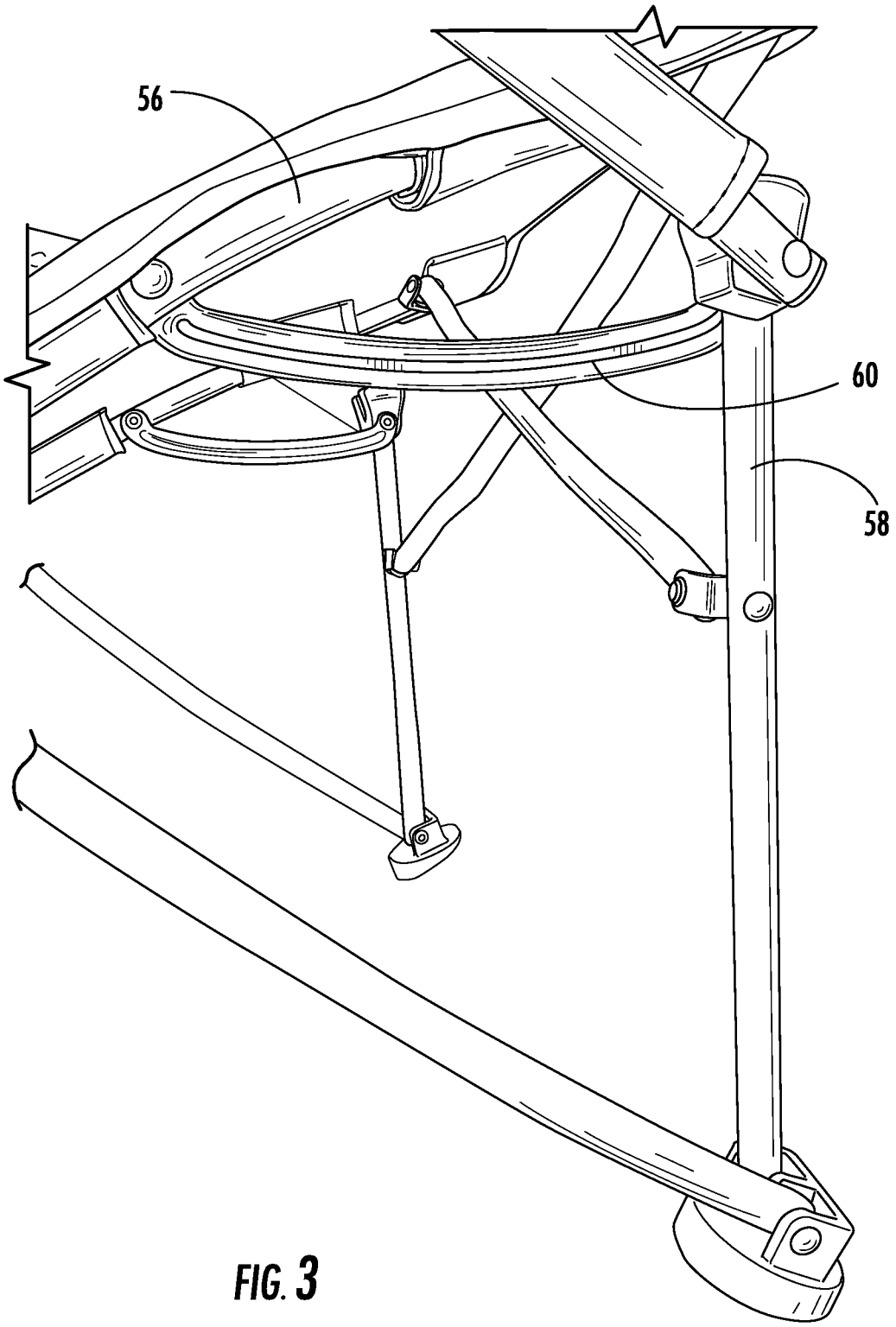
FIG. 3 illustrates an enlarged perspective view of a portion of the foldable chair of FIG. 1.

FIG. 1 is a perspective view of one embodiment of a collapsible or foldable chair 50. As shown, the chair 50 generally comprises a frame 52 and a cover 54. The cover 54 can be a single or multiple portions or components that define one or more of a seat bottom, seat back or arm rests, among other possible portions of the chair 50 (e.g., canopy or shade). The cover 54 can comprise a fabric material, any other flexible, rigid and/or semi-rigid material and/or the like, as required or desired.

With continued reference to FIG. 1, the frame 52 can comprise multiple frame elements, such as a seat bottom element 56 and a seat base element 58. The seat bottom element 56 can form, at least partially, the seat bottom of the chair 50, and the seat base element 58 can form, at least partially, a base of the chair that supports the seat bottom at a desired location, which is typically spaced above a surface upon which the chair 50 rests. In the illustrated arrangement, the seat bottom element 56 is generally horizontal and the seat base element 58 is generally vertical when the chair 50 is deployed for use. However, in other frame configurations, these elements 56, 58 could have other orientations. For example, depending on whether the chair 50 is intended to be reclined, these elements could include a non-horizontal and/or non-vertical (e.g., a diagonal, other, etc.) orientation.

In some embodiments, the chair frame 52 is selectively movable between a collapsed or folded position and a deployed position. The chair 50 is useful as a seating device in the deployed position. The seat bottom element 56 can be configured to move toward the seat base element 58 when the chair frame 52 is moved between the folded position and the deployed position. In some arrangements, the seat bottom element 56 is positioned in any desired relationship with the seat base element 58 when the chair 50 is in the deployed position. For example, the seat bottom element 56 can abut or contact the seat base element 58 directly or indirectly (such as by way of the illustrated U-shaped rest or receptacle) when the chair 50 is in the deployed position.

In some configurations, the chair 50 comprises a guide arrangement comprising at least one guide element 60 along each side that guides the seat bottom element 56 toward an appropriate position relative to the seat base element 58 when the chair 50 moves from the folded position to the deployed position. The guide element(s) 60 can guide the frame elements throughout a portion or an entirety of the movement between the folded position and the deployed position. As used herein, the term "guide" is used in accordance with its ordinary meaning and can include arrangements that may influence, restrain, restrict or limit movement of one element relative to another element. In the illustrated arrangement, the guide arrangement includes a pair of guide elements, which can be of the same or substantially the same construction. Alternatively, the guide elements may differ from one another.

In the illustrated arrangement, each of the guide elements 60 is positioned on a side of the seat bottom element 56 and/or the seat base element 58. The guide elements 60 can be pivotally attached to at least one and preferably both of the seat bottom element 56 and the seat base element 58. In some embodiments, the body of the guide element 60 extends generally along the seat bottom element 56. Thus, in the straight configuration as illustrated in FIGS. 1 to 4, the guide element(s) 60 can possibly pinch a user's hand between the seat bottom element 56 and the guide element(s) 60 if the user were to place his or her hands along the end portion of the seat bottom element 56 when moving the chair 50 toward the deployed position from a position at or towards the folded position, especially if this occurs as the user is sitting onto the chair 50. For clarity, FIGS. 1 to 4 illustrate the seat bottom element 56 slightly above or away from the seat base element 58 for clarity. Although described with respect to the seat bottom element 56 and the seat base element 58 herein, the guide arrangement can be configured to guide movement of any other frame elements, including frame elements of any one or combination of the seat bottom, seat base, seatback, arms, canopy or any struts or other supports associated with any of the foregoing.

Figure 5:
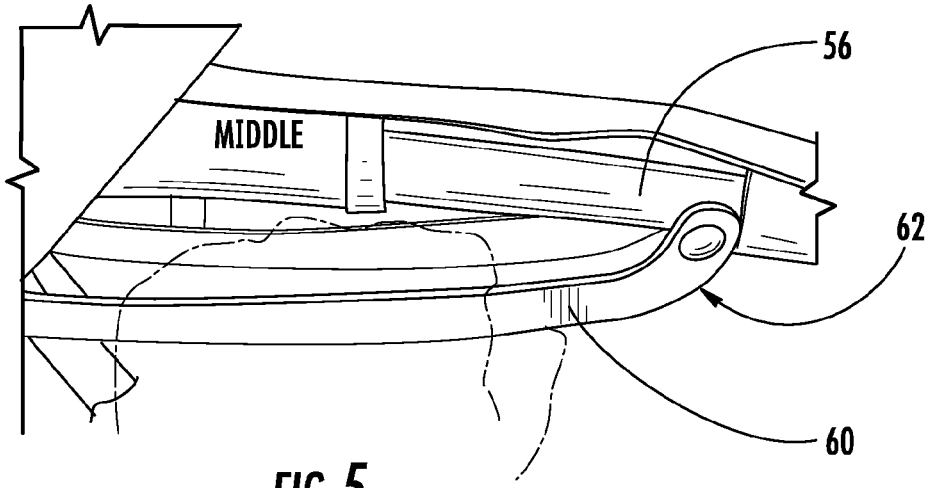
FIG. 5 illustrates a side view of one embodiment of a guide arrangement having first and second guide members with a user's hand positioned between the guide members and a frame element generally in the middle of the guide members to illustrate a clearance space.
Figure 6:
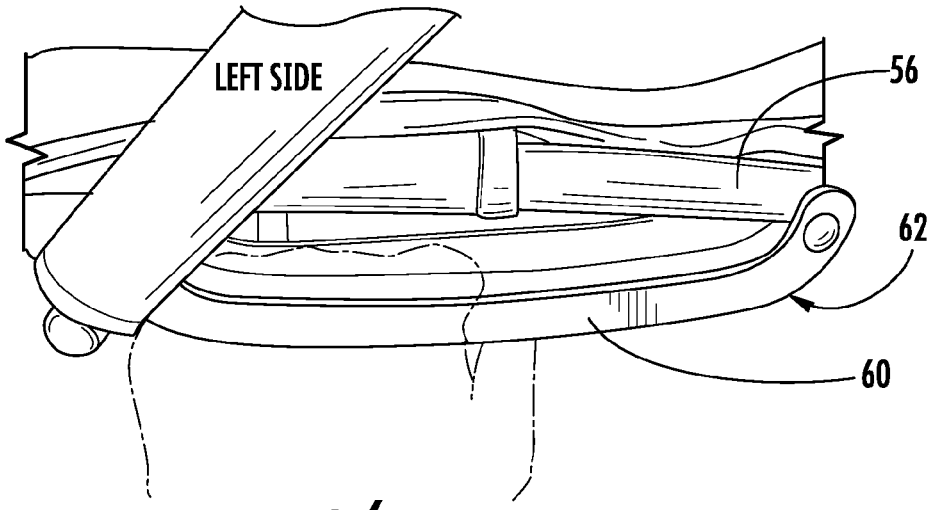
FIG. 6 illustrates a side view similar to the one in FIG. 5 with the user's hand positioned toward one side (e.g., a left side) of the guide members.
Figure 7:
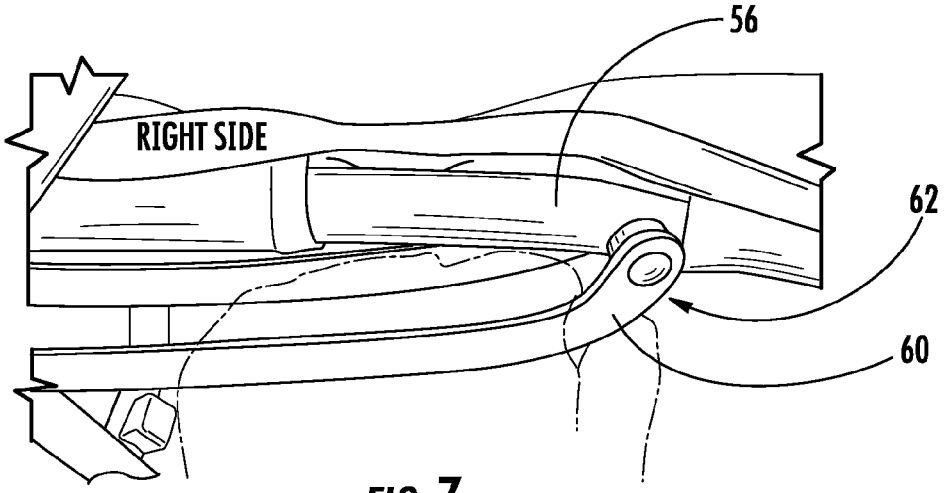
FIG. 7 illustrates a side view similar to the one in FIG. 5 with the user's hand positioned toward an opposite side (e.g., a right side) of the guide members.
Figure 8:
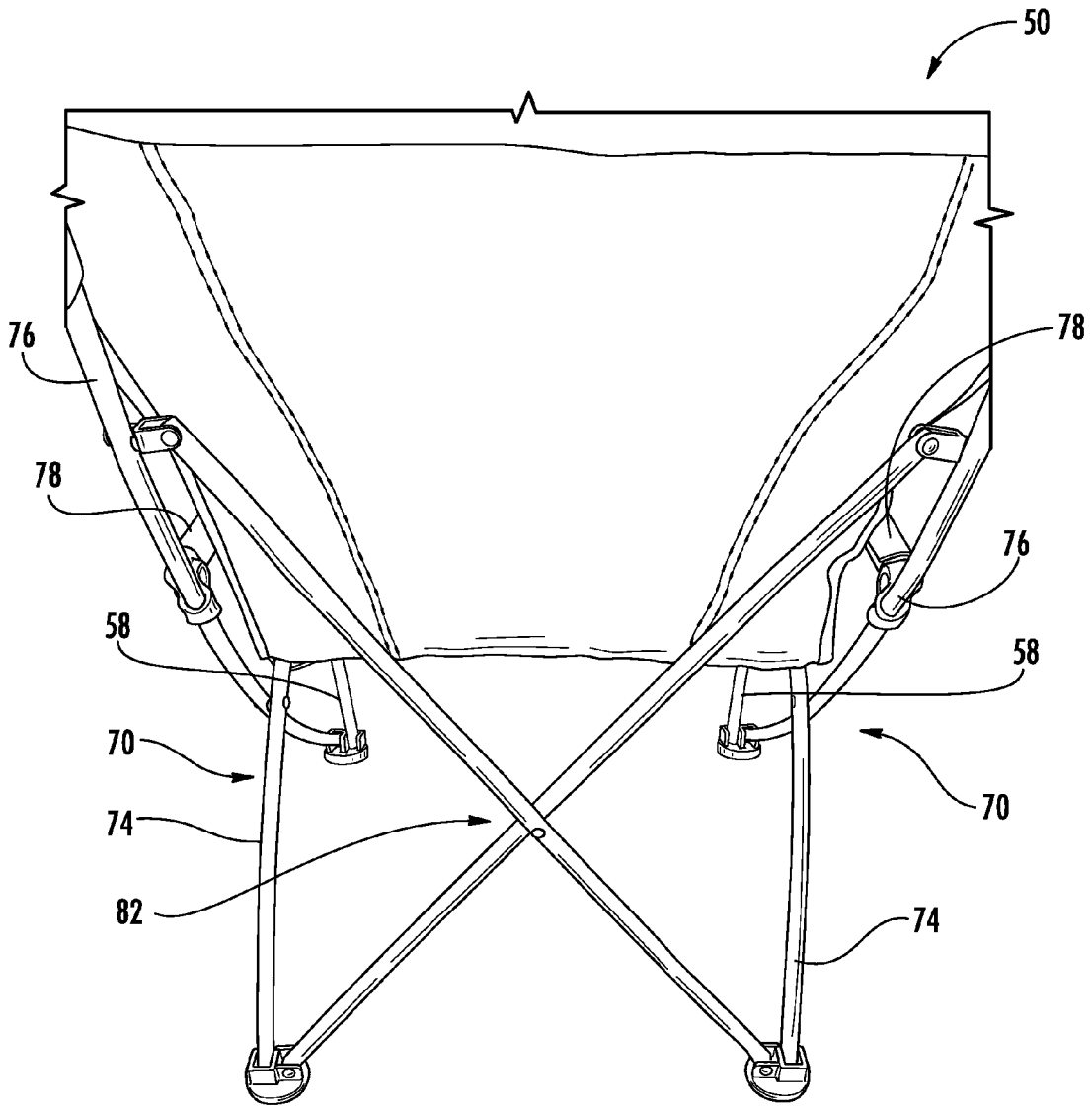
FIG. 8 illustrates a rear view of a chair having guide members for guiding a first portion of the chair frame into proper position relative to a second portion of the chair frame according to one embodiment.

FIGS. 5 to 7 illustrate one embodiment of guide elements 60 that have a first end portion 62 that is pivotally attached to the seat bottom element 56 and a second end portion pivotally attached to the seat base element 58. As shown, at least one of the end portions 62 of the guide element(s) 60 can comprise a curved or rounded end portion that spaces the body or intermediate portion of the guide element 60 away from the seat bottom element 56 (or other frame element closest to the guide element 60).

According to some configurations, both ends 62 of the guide element(s) 60 define curved or rounded end portions. The curved end portion can initially extend in a generally radial direction from the pivot axis and can then curve to extend in a direction generally tangential to a circle defined about the pivot axis such that the body or an intermediate portion of the guide element(s) 60 extends generally parallel to the seat bottom element 56 at a spaced location therefrom. In some embodiments, the body or intermediate portion of the guide element(s) 60 is advantageously positioned a distance from the seat bottom element sufficient to accommodate a user's fingers or at least a sufficient portion of the user's fingers to avoid a damaging pinch. In other words, some amount of pressure applied by the guide element(s) 60 and the seat bottom element 56 may be acceptable if the pressure is sufficiently low to avoid permanent injury. In some configurations, the body or intermediate portion of the guide element(s) 60 is spaced at least about one-half inch, at least about three-quarters inch, or at least about 1 inch or distances between the foregoing from the seat bottom element 56. In some configurations the spacing can be at least about one and one-half inches. In some configurations, the spacing can be a value or a range of values between any of the aforementioned values or any sub-range within those values.

FIGS. 8 to 11 illustrate additional views of one embodiment of a chair 50, which can be the same as or similar to the chair 50 depicted in FIGS. 1 to 7. Thus, in some arrangements, the chair 50 can combine features described in connection with FIGS. 1 to 7 and features described in connection with FIGS. 8 to 11.

With reference to the chair 50 illustrated in FIGS. 8 to 11, the outboard guide elements 60 have been omitted. As shown, the chair 50 can include a single guide element 60 between the seat bottom 56 and the seat base 58 on each side of the chair 50. The guide elements 60 can comprise curved portions to space at least an intermediate portion of the guide elements 60 from the associated portions of the seat bottoms 56, as noted above.

In some embodiments, the chair frame 52 includes side frame portions 70 that are mirror images of one another and are connected by a center frame portion 72. Each side frame portion 70 can comprise the seat base 58, a first side strut 74 and a second side strut 76. In the illustrated arrangement, a portion of the first side strut 74 defines the seat bottom 56 and another portion of the first side strut 74 defines a rear leg of the chair 50. A portion of the second side strut 76 defines a seat back of the chair 50 and another portion of the second side strut 76 extends from an intersection with the first side strut 74 to a lower end portion of the seat base 58, which defines a front leg of the chair 50. As shown, the first side strut 74 and the second side strut 76 can be pivotally coupled to one another at or near a junction between the seat portion and the seat back of the chair 50. Each side frame portion 70 can further comprise a seat arm 78 having a first end pivotally coupled to an upper end portion of the seat base 58 and a second end pivotally coupled to the seat back portion of the second side strut 76.

In some arrangements, the center frame portion 72 can comprise at least one foldable cross-strut assembly that connects the side frame portions 70 to one another. The at least one foldable cross-strut assembly can include two strut members pivotally coupled at intermediate locations to be foldable toward a collapsed position and expandable toward an expanded position in which the strut members define an angle therebetween and can be generally in the shape of an X or other crisscross or intersecting shape.

The illustrated arrangement includes a front cross-strut assembly 80 and a rear cross-strut assembly 82. The front cross-strut assembly 80 connects front end portions of the seat bottoms 56 and intermediate portions of the seat bases 58. The rear cross-strut assembly 82 connects lower end portions of the first side strut 74 and intermediate portions of the second side struts 76. The front cross-strut assembly 80 and the rear cross-strut assembly 82 are sized differently than one another. That is, the strut members of the cross-struts 80, 82 are different in length between the front cross-strut 80 and the rear cross-strut 82. In the illustrated arrangement, the strut members of the front cross-strut 80 are shorter than the strut members of the rear cross-strut 82. Such an arrangement is preferred so that appropriate support is provided to each of the front and rear portions of the chair 50. As a result of this arrangement, during unfolding or expansion of the chair 50, the front and rear portions of the side frame portions 70 separate from one another at different rates. This can result in complications with the seat bottoms 56 properly engaging the respective seat bases 58 when the chair 50 is unfolded, especially if the unfolding occurs quickly.

Figure 4:
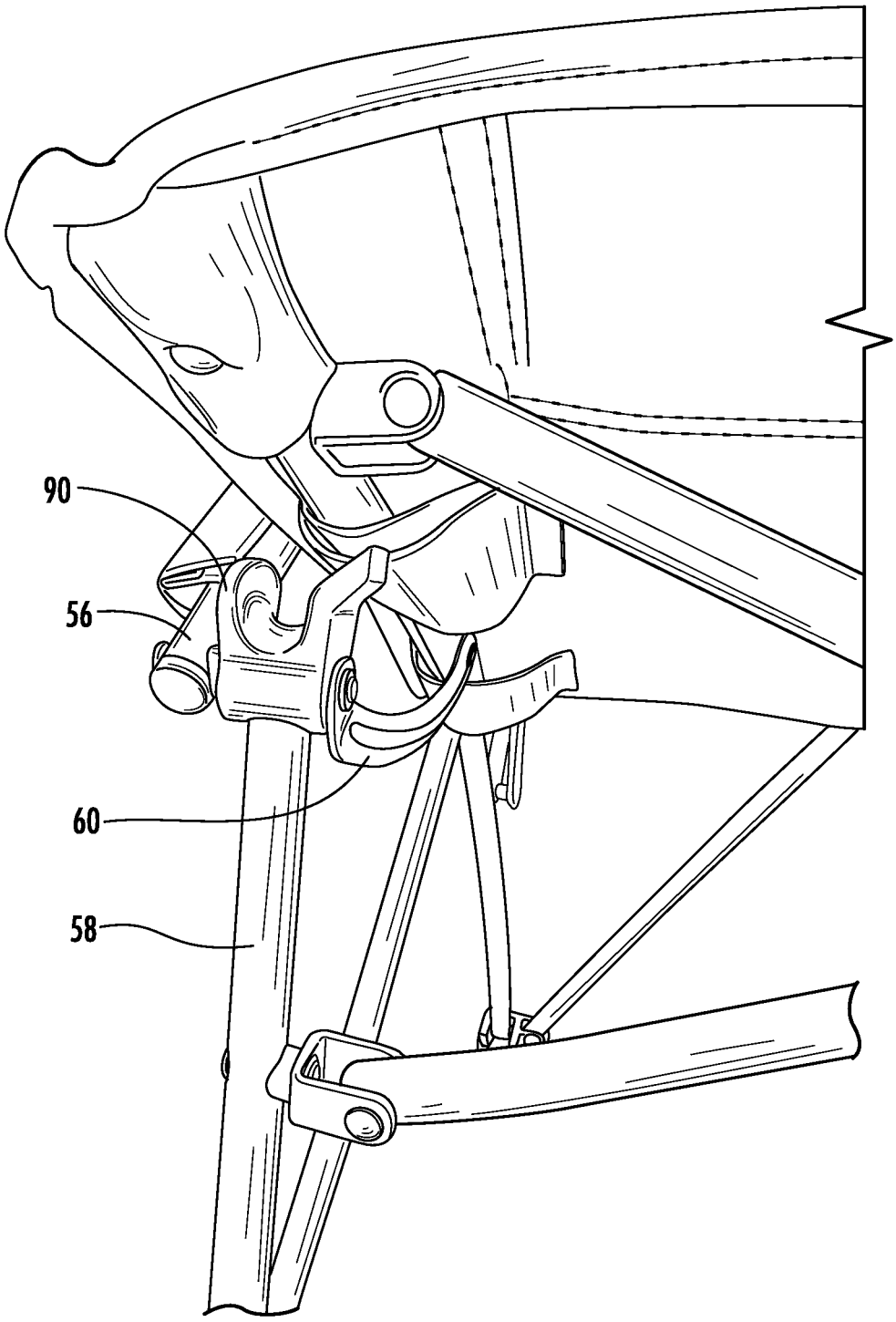
FIG. 4 illustrates another perspective view of the portion of the foldable chair of FIG. 1.
Figure 9:
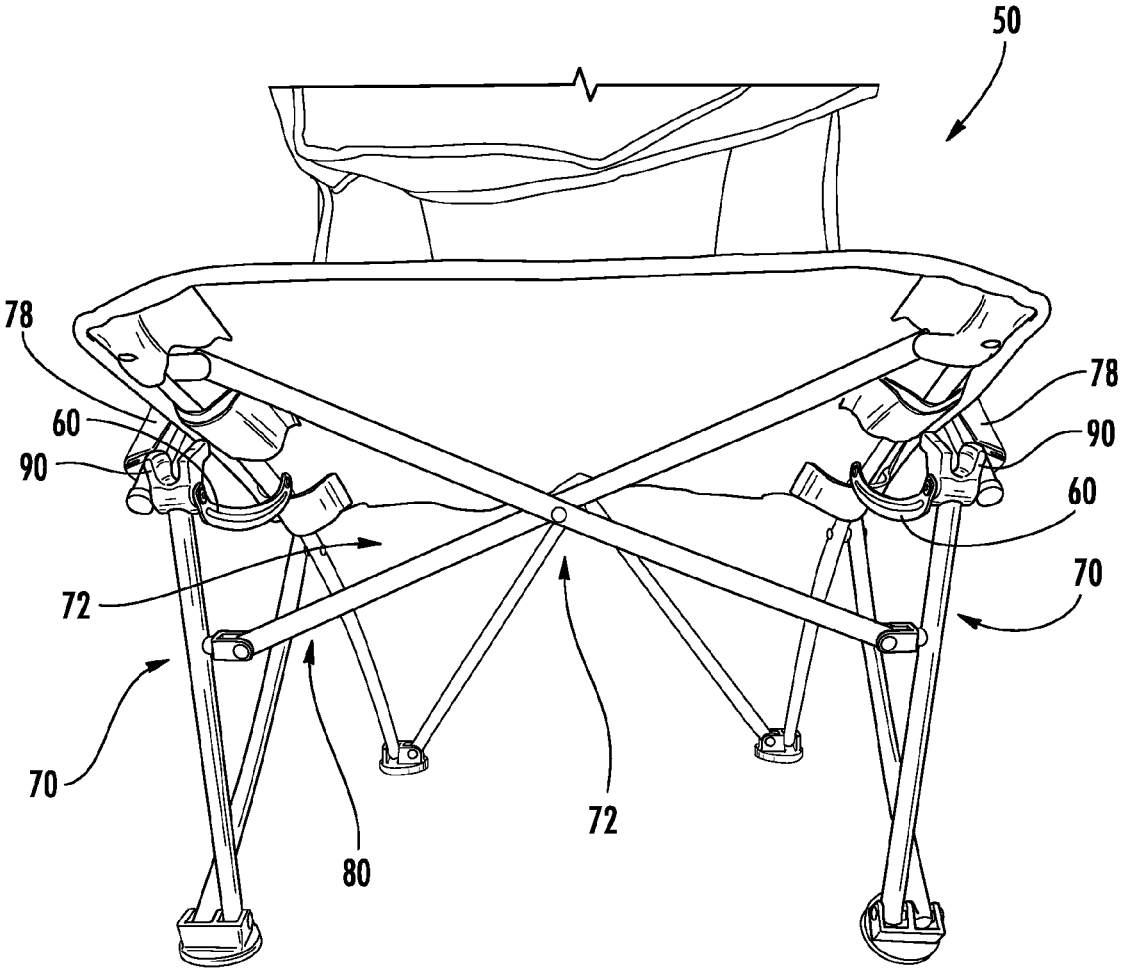
FIG. 9 illustrates a front view of the chair of FIG. 8.
Figure 10:
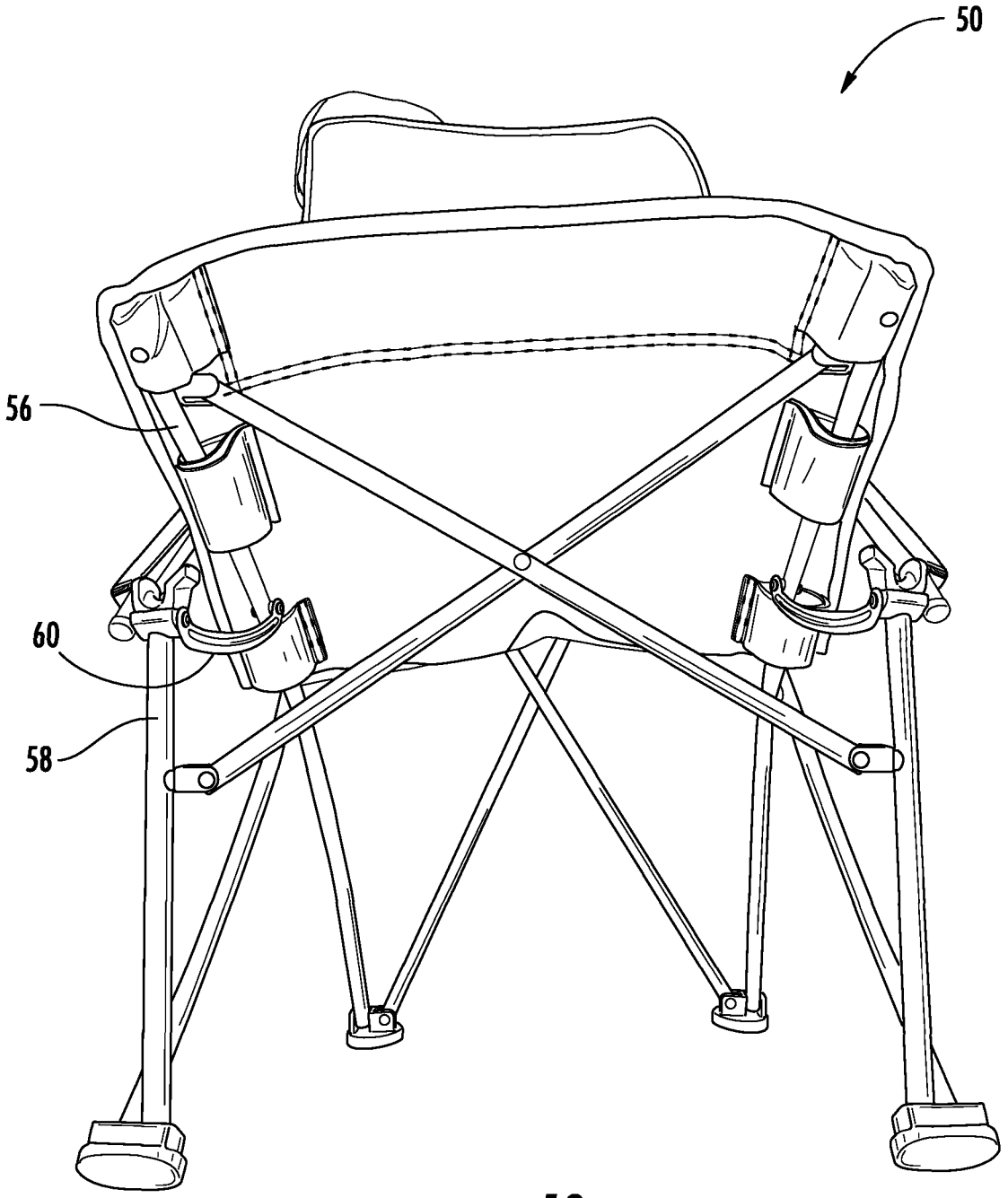
FIG. 10 provides another front view of the chair of FIG. 8 illustrating the different width positions of the front and rear legs caused by the different rates of opening of the front and rear legs according to one embodiment.
Figure 11A:
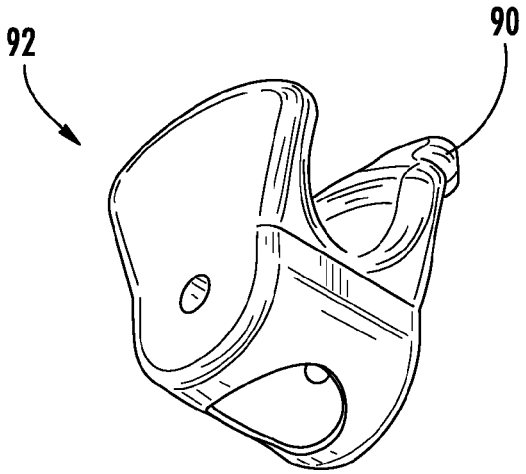
FIGS. 11A to 11D illustrate several views of a cradle comprising a guide member according to one embodiment.
Figure 11B:
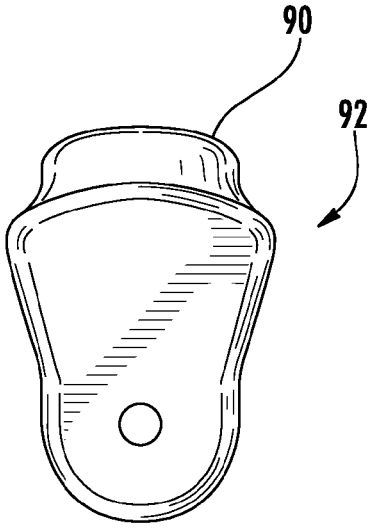
Figure 11C:
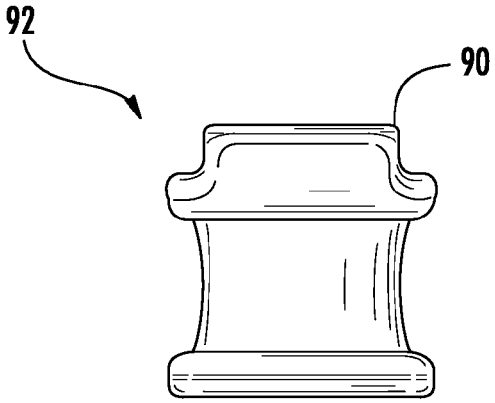
Figure 11D:
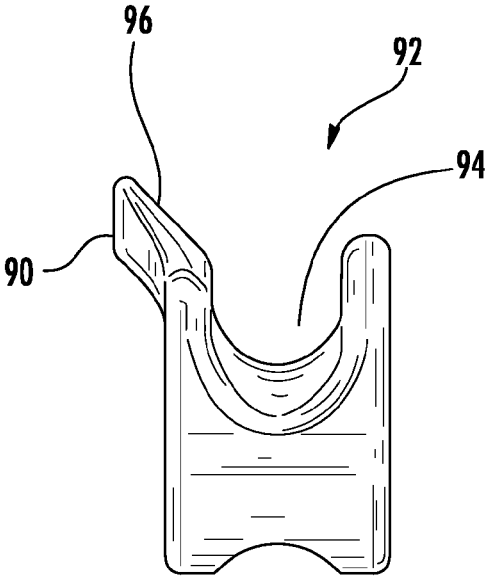

In some configurations, as illustrated in, among other places, FIGS. 4 and 9, the chair 50 includes guide members 90, each of which facilitates proper engagement of the seat bottoms 56 with the respective seat bases 58 when the chair 50 is unfolded to an expanded or unfolded position. The guide members 90 can be configured to contact the respective seat bottoms 56, if necessary, to help guide the seat bottom 56 into proper engagement with the seat base 58. The guide members 90 can be located inboard of the seat bottoms 56 when the seat bottoms 56 are in the proper unfolded position. The guide members 90 can be located above the seat bottoms 56 when the seat bottoms 56 are in the proper unfolded position.

With reference to FIGS. 11A to 11D, the guide members 90 can be coupled to, integrated with or unitary with a stop, rest, support or cradle 92 that supports the seat bottoms 56 in the unfolded position. In the illustrated arrangement, the guide members 90 are unitary projecting portions of the cradles 92. The cradle 92 can include a body that defines a recess 94 configured to receive the seat bottom 56. As shown, the recess 94 can be generally U-shaped or semi-circular when viewed from the front. In some embodiments, the recess 94 defines a width or diameter that is sufficient for the recess 94 to receive the seat bottom 56. In some embodiments, the recess 94 advantageously receives the seat bottom 56 in a relatively snug or tight manner. In some arrangements, the width or diameter of the recess 94 is similar to or only slightly larger than the width or diameter of the seat bottom 56. In the illustrated arrangement, the width of the recess 94 is about 16.5 mm. However, in other embodiments, depending on the desired or required shape or design, the width of the recess 94 can be less or more than 16.5 mm.

The guide member 90 can define a guide surface 96 that extends upwardly from one side of the recess 94. The illustrated guide surface 96 is angled relative to the side wall surface of the recess 94. In the illustrated arrangement, the guide surface 96 is linear or flat and is angled at about 45 degrees. The guide surface 96 extends away from the recess a horizontal distance, which can be, for example, about 12 mm. Thus, the horizontal distance can be about three-quarters of the width of the recess. In some embodiments, the horizontal distance is at least about one-half of the width of the recess 94 up to about three-quarters or more of the width of the recess 94. In some arrangements, the horizontal distance of the guide surface 96 is small enough that the guide member 90 does not interfere with other components of the chair 50 during the folding and unfolding process.

In the illustrated arrangement, the maximum length of the guide surface 96 in the lengthwise direction of the seat bottom 56 is less than a maximum length of the recess 94. Preferably, the guide surface 96 is centered lengthwise relative to the recess 94. As a result, a single design of the cradle 92 can be used on each side of the chair 50 with the guide member 90 being positioned on the inboard side. As noted above, the use of cradles 92 with guide members 90 can ensure that an adjacent frame member of the chair properly secures to the recess 94. This can facilitate the consistent expansion of the chair, can help improve safety (e.g., as improperly expansion of the foldable chair is prevented, as the dangers associated with correcting an improperly expanded foldable chair are avoided, etc.).

Figure 12A:
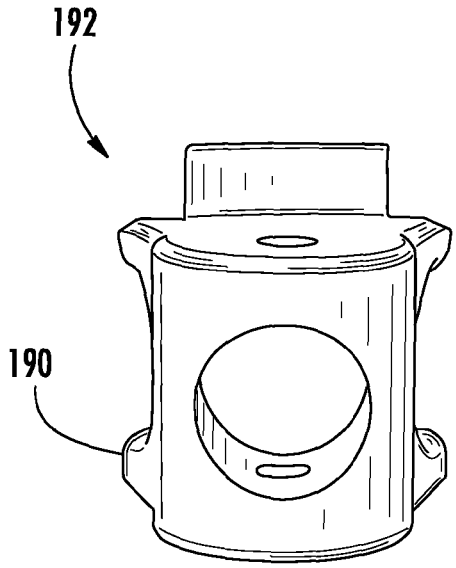
FIGS. 12A to 12C illustrate different view of a cradle comprising a guide member according to another embodiment.
Figure 12B:
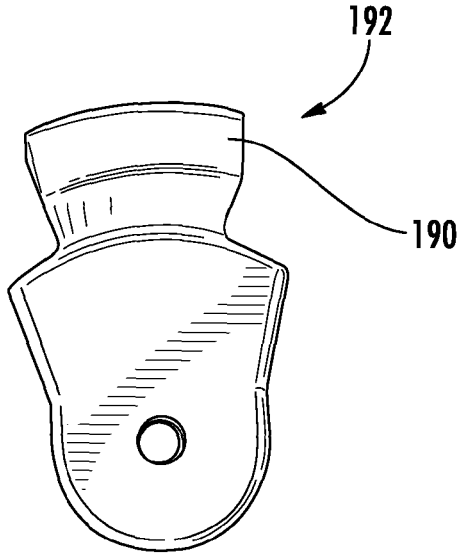
Figure 12C:
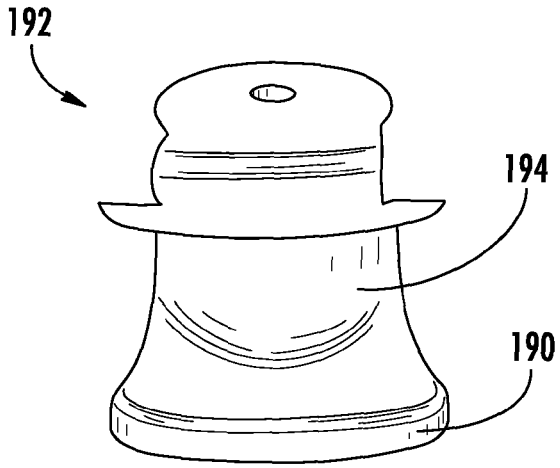

A different embodiment of a cradle 192 comprising a guide member 190 is illustrated in FIGS. 12A to 12C. The cradle 192 can be similar to the one discussed herein with reference to FIGS. 11A to 11D. However, as shown, in some embodiments, the cradle can include a slightly modified shape and design. For example, in the depicted arrangement, outer portions of the rib along the side of the guide member 190 that connects to the frame of a chair have been trimmed or otherwise eliminated. Such a configuration can accommodate for the specific design of the chair frame and can facilitate the opening of the closing of a collapsible or foldable frame, as desired or required. As with the embodiment of FIGS. 11A to 11D, the illustrated embodiment includes a guide member 190 that can facilitate the proper positioning of a frame member within the cradle.

The systems, apparatuses, devices and/or other articles disclosed herein may be formed through any suitable means. The various methods and techniques described above provide a number of ways to carry out the inventions. Of course, it is to be understood that not necessarily all objectives or advantages described may be achieved in accordance with any particular embodiment described herein. Thus, for example, those skilled in the art will recognize that the methods may be performed in a manner that achieves or optimizes one advantage or group of advantages as taught herein without necessarily achieving other objectives or advantages as may be taught or suggested herein.

Although several embodiments and examples are disclosed herein, the present application extends beyond the specifically disclosed embodiments to other alternative embodiments and/or uses of the inventions and modifications and equivalents thereof. It is also contemplated that various combinations or subcombinations of the specific features and aspects of the embodiments may be made and still fall within the scope of the inventions. Accordingly, it should be understood that various features and aspects of the disclosed embodiments can be combine with or substituted for one another in order to form varying modes of the disclosed inventions. Thus, it is intended that the scope of the present inventions herein disclosed should not be limited by the particular disclosed embodiments described above, but should be determined only by a fair reading of the claims that follow.

While the embodiments disclosed herein are susceptible to various modifications, and alternative forms, specific examples thereof have been shown in the drawings and are herein described in detail. It should be understood, however, that the inventions are not to be limited to the particular forms or methods disclosed, but, to the contrary, the inventions are to cover all modifications, equivalents, and alternatives falling within the spirit and scope of the various embodiments described and the appended claims. Any methods disclosed herein need not be performed in the order recited. The methods disclosed herein include certain actions taken by a practitioner; however, they can also include any third-party instruction of those actions, either expressly or by implication. For example, actions such as "providing" include "instructing providing." The ranges disclosed herein also encompass any and all overlap, subranges, and combinations thereof. Language such as "up to," "at least," "greater than," "less than," "between," and the like includes the number recited. Numbers preceded by a term such as "about" or "approximately" include the recited numbers. For example, "about 10 mm" includes "10 mm." Terms or phrases preceded by a term such as "substantially" include the recited term or phrase. For example, "substantially parallel" includes "parallel."

What is claimed is:

1. A folding chair, comprising:

a first frame element;

a second frame element, wherein the first frame element moves from a first position remote from the second frame element to a second position toward, adjacent to or against the second frame element; and a cradle comprising a guide member that guides the first frame element into the cradle;

wherein the guide member is pivotally connected to both the first frame element and the second frame element.

2. The folding chair of claim 1, wherein the cradle comprises a recess that is configured to receive at least a portion of the first frame element.

3. The folding chair of claim 2, wherein the recess is shaped and sized to receive a corresponding surface of the first frame element.

4. The folding chair of claim 1, wherein the first frame element is configured to be positioned within the recess when the folding chair is open and adapted to receive an occupant.

5. The folding chair of claim 1, wherein the guide member comprises a guide surface that extends laterally along at least one side of the cradle so at to guide the first frame element within a recess of the cradle.

6. The folding chair of claim 5, wherein the guide surface is sloped relative to a direction in which the first frame element is configured to approach the cradle.

7. The folding chair of claim 1, further comprising at least one guide element that guides the first frame element toward the second frame element.

8. The folding chair of claim 7, wherein the at least one guide element comprises at least one curved or rounded end portion that spaces a body of the guide element away from the first frame element when the first frame element is in the second position.

9. A folding chair, comprising:

a first frame element;

a second frame element, wherein the first frame element is configured to move from a first position when the folding chair is not extended and a second position when the folding chair is extended and configured to receive an occupant;

wherein, in the second position, the first frame element is adjacent to or against the second frame element; and a guide member that guides the first frame element into a recess adjacent the guide member, wherein the recess is configured to receive at least a portion of the first frame element;

wherein the guide member is pivotally connected to both the first frame element and the second frame element.

10. The folding chair of claim 9, wherein the recess is shaped and sized to receive a corresponding portion of the first frame element that is configured to be positioned within the recess.

11. The folding chair of claim 9, wherein the guide member is located on or part of a cradle.

12. The folding chair of claim 9, further comprising at least one guide element that guides the first frame element toward the second frame element, wherein the at least one guide element comprises at least one curved or rounded end portion that spaces a body of the guide element away from the first frame element when the first frame element is in the second position.

13. A folding chair, comprising:

a first frame element;

a second frame element, wherein the first frame element moves from a first position remote from the second frame element to a second position toward, adjacent to or against the second frame element; and at least one guide element that guides the first frame element toward the second frame element, wherein the at least one guide element comprises at least one curved or rounded end portion that spaces a body of the guide element away from the first frame element when the first frame element is in the second position;

wherein the at least one guide element is pivotally connected to both the first frame element and the second frame element.

14. The folding chair of claim 13, wherein the at least one guide element comprises two curved end portions.

15. The folding chair of claim 13, wherein the at least one guide element comprises a first guide element and a second guide element.

16. The folding chair of claim 15, wherein the first and second guide elements are positioned on opposite sides of the first frame element.

17. A folding chair, comprising:

a first frame element;

a second frame element, wherein the first frame element moves from a first position remote from the second frame element to a second position toward, adjacent to or against the second frame element; and at least one guide element that guides the first frame element toward the second frame element, wherein the at least one guide element comprises at least one curved or rounded end portion that spaces a body of the guide element away from the first frame element when the first frame element is in the second position;

wherein the at least one guide element comprises a first guide element and a second guide element.

18. The folding chair of claim 17, wherein the first and second guide elements are positioned on opposite sides of the first frame element.

* * * * *